United States Patent [19]

Raskin

[11] 4,422,388

[45] Dec. 27, 1983

[54] WOOD AND OTHER SOLID REGISTER BURNER

[76] Inventor: Jean F. Raskin, 2255 Laird Blvd., Ville Mont-Royal, Quebec, Canada, H3P 2V7

[21] Appl. No.: 326,050

[22] Filed: Dec. 1, 1981

[51] Int. Cl.[3] ..... F23C 1/10

[52] U.S. Cl. ..... 110/261; 110/264; 110/263

[58] Field of Search ..... 110/243, 244, 246, 263, 110/264, 265, 336, 337, 338, 339, 340, 309, 297, 260, 261

[56] References Cited

U.S. PATENT DOCUMENTS

| | | | |
|---|---|---|---|
| 268,035 | 11/1882 | McAuley | 110/264 |
| 1,926,637 | 8/1927 | Suffern | 110/263 |
| 1,946,011 | 2/1934 | Burg | 110/264 |
| 2,800,093 | 2/1952 | Burg | 110/264 |
| 2,979,000 | 4/1961 | Sifrin et al. | 110/309 |
| 3,702,595 | 11/1972 | Muirhead et al. | 110/8 |
| 3,777,677 | 12/1973 | Ali et al. | 110/244 X |
| 3,777,678 | 12/1973 | Lutes et al. | 110/244 |
| 3,834,326 | 9/1974 | Sowards | 110/8 |
| 3,834,327 | 9/1974 | Hellstrom et al. | 110/18 |
| 3,837,303 | 9/1974 | Baardson | 110/233 X |
| 3,856,455 | 12/1974 | Otway | 110/264 X |
| 3,924,548 | 12/1975 | DuChambon | 110/8 |
| 3,939,782 | 2/1976 | Albrecht | 110/8 |
| 3,941,065 | 3/1976 | Albrecht | 110/8 |
| 4,033,505 | 7/1977 | Lutes et al. | 110/264 |
| 4,266,931 | 5/1981 | Struckmann | 110/246 X |
| 4,351,251 | 9/1982 | Brashears | 110/263 X |

FOREIGN PATENT DOCUMENTS

| | | | |
|---|---|---|---|
| 458444 | 1/1973 | Australia | 110/244 |
| 2339135 | 8/1977 | France | 110/246 |

*Primary Examiner*—Henry C. Yuen
*Assistant Examiner*—David E. Helmbold
*Attorney, Agent, or Firm*—Steele, Gould & Fried

[57] ABSTRACT

A solid fuel burner of the type having a cylindrical combustion chamber with a horizontal axis, in which the solid fuel is introduced tangentially into at one end, ignited, and moved spirally to the other end. The chamber is lined with fire resistant material. At least part of the bottom portion of the chamber has an opening therein for admitting a combustion-supporting gas into the chamber to both support combustion and fluidize the material being burnt. The openings are formed by spacing apart the fire-resistant lining of the chamber to define a plurality of slots through which the combustion-supporting gas is blown.

3 Claims, 3 Drawing Figures

WOOD AND OTHER SOLID REGISTER BURNER

The present invention relates to an improved solid fuel burner.

Burners for burning solid fuel such as wood chips or sawdust are well known. The known burners usually comprise a cylindrical burning chamber having a longitudinal axis generally horizontal. Fuel material to be burnt is introduced tangentially into the chamber adjacent one end. Means are provided at the one end for igniting the fuel material, and the material burns as it moves in spiral fashion, toward outlet means at the other end of the burner. Air can be introduced at spaced locations along the length of the chamber to aid combustion and also to aid in moving the material. U.S. Pat. No. 3,777,678 shows such a burner.

The known burners have disadvantages however. Material in the form of unburnt fuel particles and ash, accumulates in the bottom of the burner thus necessitating frequent cleaning of the burner. In addition, wet and/or coarse fuel material requires more igniting fuel and combustion supporting gas to maintain the combustion process.

To overcome, or at least minimize the above disadvantages, the present invention proposes a burner having a bottom portion in the burning chamber through which a combustion-supporting gas can be introduced to both support combustion more evenly and to fluidize the material being transported through the chamber, thus allowing more complete combustion, and removal of residue from the bottom of the chamber.

It is well known to provide burners in which combustion gas is introduced into the bottom of the burning chamber to provide a fluidized bed. U.S. Pat. Nos. 3,924,548 and 3,941,065 are representative of such burners. The present invention however employs a novel structure in the burner for introducing combustion gases from the bottom of the chamber. To provide burners which last for a long time with a minimum of maintainance, many burners are provided with burning chambers lined with heat resistant material such as firebricks, refractory material or heat resistant grating. The present invention proposes an improved solid fuel burner, having a combustion chamber lined with a layer of heat resistant material, and having means for introducing the combustion supporting gas into the bottom of the chamber through the heat resistant layer.

The burner of the present invention has a bottom section in the combustion chamber, which section is made of pieces of heat resistant material. The heat resistant pieces are mounted on support means in spaced-apart relation and a combustion-supporting gas is blown through the spaces between the heat resistant pieces into the burning chamber to support combustion and to fluidize fuel material within the chamber.

More particularly, the burner according to the invention comprises a burning chamber defined by a cylindrical or pseudo-cylindrical wall whose longitudinal axis is generally horizontal. One end of the wall is closed and means are provided adjacent this one end for introducing the material to be burnt tangentially into the chamber. Means at the one end ignite the material to have it burn as it moves spirally through the chamber away from the one end. The interior of the burning chamber is lined with a heat resistant material. Means are provided along at least part of the bottom portion of the chamber for introducing a combustion supporting gas into the chamber, through spaces defined between the heat resistant lining both to support combustion of the material to be burnt in the chamber and to fluidize the material being burnt.

A preferred embodiment of the invention will now be described in detail having reference to the accompanying drawings in which.

Figure 1:
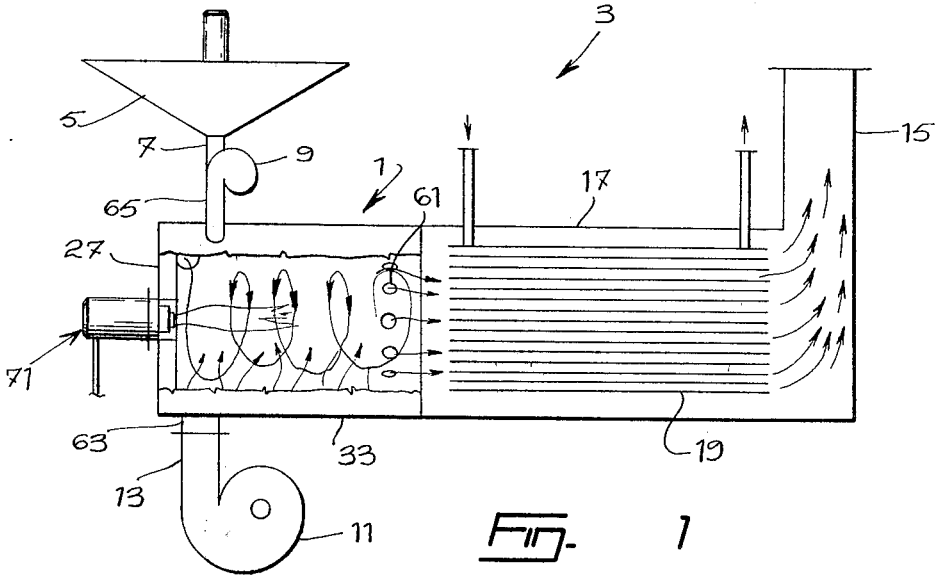
FIG. 1 is a partial longitudinal cross-section view of a fuel burning system incorporating a burner according to the invention.
Figure 2:
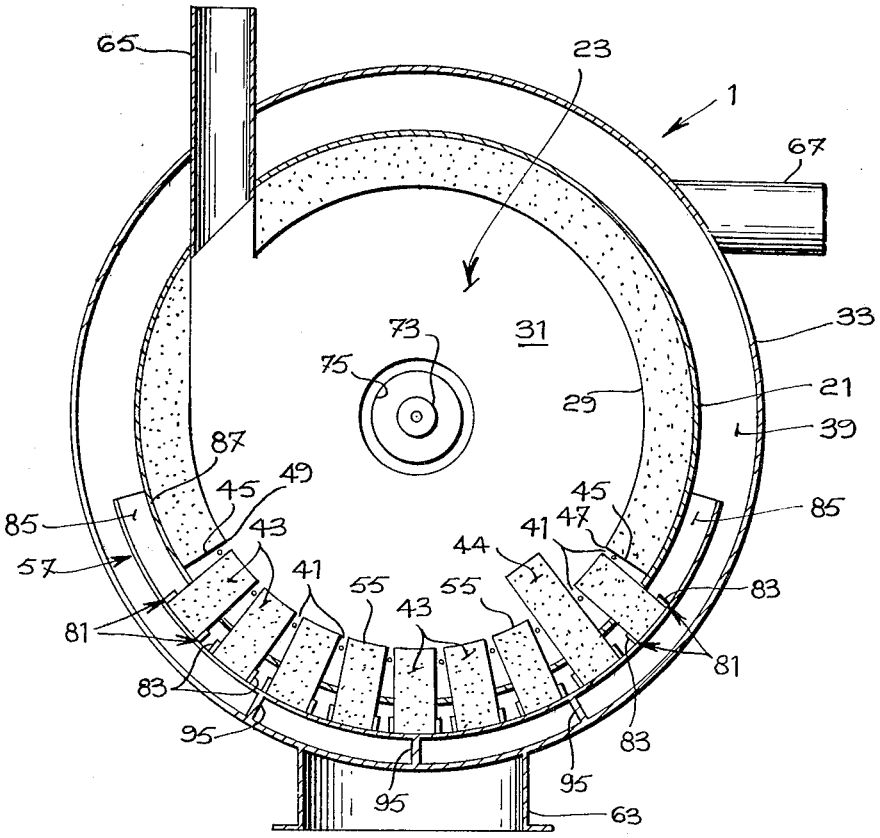
FIG. 2 is a transverse cross-section view of the burner.
Figure 3:
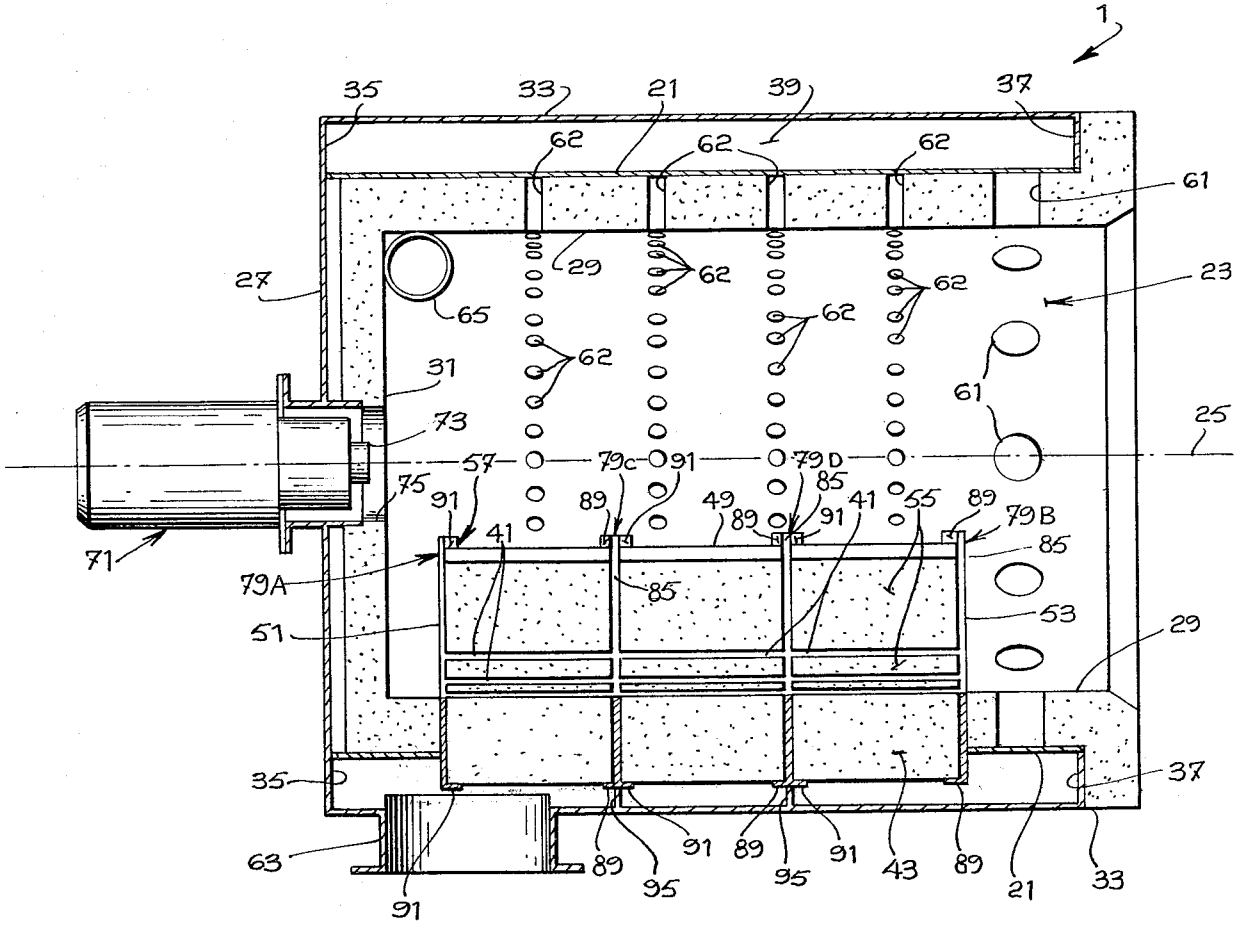
FIG. 3 is a detailed, longitudinal cross-section view of the burner.

The fuel burner 1 as shown in FIGS. 1 to 3, is incorporated in a fuel burning system 3. Means are provided for feeding solid fuel, such as sawdust, to the burner 1. These means include a source of fuel, such as a hopper 5, at least one duct 7 leading from the hopper 5 to burner 3, and a blower or impeller 9 in the duct 7 for feeding the fuel from the hopper 5 to the burner 1. The system 3 also includes means for supplying a combustion supporting gas, such as air, to the burner 1. These means comprise a blower 11 and a duct 13 leading from the blower 11 to the burner 1. The system 3 includes an exhaust duct 15 leading away from the burner 1. The exhaust duct 15 carries away the combustion products from the burner. The portion 17 of the exhaust duct 15 adjacent the burner can be enlarged, as shown in FIG. 1, to accomodate a heat exchanger 19.

The burner 1 of the present invention, as shown more clearly in FIGS. 2 and 3 has a cylindrical wall 21 defining a cylindrical burning chamber 23. It should be noted that the chamber 23 may also have a pseudo-cylindrical wall, i.e. ellipsoidal or cylindrical with flat portions. The longitudinal axis 25 of the cylindrical chamber 23 is generally horizontal. One end of the wall 21 is closed with a circular end wall 27. The inner surfaces of the walls 21 and 27 are covered with layers 29 and 31 respectively of suitable heat resistant material. An outer cylindrical wall 33 surrounds, and is concentric to, the inner chamber wall 21. Ring-like end walls 35 and 37 join the ends of the concentric cylindrical walls 21 and 23 together to form a tubular distributing chamber 39 about the burning chamber 23. The ring-like end wall 35 at the inlet end of chamber 23 preferably lies in the same plane as the circular end wall 27. The exhaust duct 15 can be attached to the outer wall 33 at the open outlet end of the chamber 23, adjacent the outlet end wall 37.

A set of air inlets are provided in the bottom portion of the burning chamber 23. The inlets comprise a plurality of narrow slots 41 arranged in longitudinal columns and circumferential rows to provide a regular array. The array of slots 41 extends over most of the length of the burner chamber 23 and generally over the bottom third of the chamber 23. The slots 41 are preferably formed by gaps left between a regular array of firebricks 43 mounted in an opening 45 formed in both the firebrick layer 29 and the inner cylindrical wall 21. The opening 45 has a pair of parallel straight sides 47 and 49, extending parallel to the longitudinal axis 25 of chamber 23 and a pair of parallel, curved sides 51 and 53 extending transverse to the sides 47 and 49.

Means are provided for supporting the array of firebricks 43 in the opening 45 with their inner surfaces 55 generally flush with the inner surface of the firebrick layer 29. The support means preferably comprises a grid 57, fixed to the chamber wall 21, as will be described later.

A second set of air inlets are provided adjacent the open outlet end of the chamber 23. This second set of air inlets comprises a circle of radially-extending ports 61 of large diameter joining the distributing chamber 39 to the burning chamber 23. The ports 61 extend through the wall 21 and firebrick layer 29.

A third set of air inlets may be provided between the inlet end and outlet end of the chamber 23, if desired. This third set of air inlets comprises a plurality of circles of radially extending ports 62 of small diameter joining the distributing chamber 39 to the burning chamber 23 at given intervals at its length. The ports 62 also extend through the wall 21 and firebrick layer 29.

The air duct 13 is connected to the distributing chamber 39 via an air inlet 63 located close to the end wall 27. The fuel duct 7 is connected to the burning chamber 23 by at least one inlet tube 65 passing through the walls 21 and 33 and firebrick layer 29. The inlet tube 65 opens tangentially into the chamber 23 adjacent the firebrick layer 31. If desired, a second inlet tube 67, spaced ninety degrees from the first inlet tube 65, can lead tangentially into the chamber 23 adjacent the layer 31, from the fuel duct 7. A burning device 71 is mounted centrally in the end wall 27 of the chamber 23. The nozzle 73 of the burning device 71 is located in a central opening 75 in the firebrick layer 31, aligned with the longitudinal axis 25 of the chamber 23, and pointing into the chamber.

In operation, the fuel to be burned is transported from the hopper through the duct 7 and into the chamber 23 via the inlet 65, and inlet 67 if provided. The burning device 71 projects a flame axially into the chamber 23 to ignite the fuel as it moves spirally through the chamber away from the end wall 27. Simultaneously, air is introduced into the distributing chamber 39 from the duct 13 via the inlet 63. The air flows about the chamber 23, being pre-heated and simultaneously cooling the burner, and enters the chamber 23 through slots 41 to both fluidize the fuel in the chamber to assist its movement through the chamber, and to enhance combustion of the fuel substantially throughout the length of the chamber. Air also enters the chamber 23 through the circles of ports 62 to support combustion throughout the length of the chamber while simultaneously cooling the wall of the burner. Last of all, air enters the chamber 23 through the circle of ports 61 at the end of the chamber to ensure complete combustion of the fuel being burnt before it leaves the burner.

The grid 57 for supporting the array of firebricks 43 in the opening 45 comprises a number of curved, spaced-apart main supports 79 and a plurality of pairs 81 of straight secondary supports 83 extending transversely between the adjacent main supports 79 to hold them together. The main supports 79 extends across the opening 45, transversely between the straight sides 47 and 49 and project past the sides 47 and 49 to overlie the chamber wall 21. Each main support 79 has a web 85 which extends transverse to the longitudinal axis 25 of the chamber 23. The inner edge 87 of web 85 has a radius of curvature equal to the radius of curvature of the outer surface of wall 21. The main supports 79 are equally spaced-apart across the opening 45 with one support **79*a* adjacent one curved side 51 of opening 45 and with a second support 79*b* adjacent the other curved side 53 of opening 45. Each support 79 has a pair of flanges 89, 91 extending in opposite directions transverse to the web and adjacent the outer edge 93 of the web. If desired, the flanges 89, 91 on the outer supports 79*a*, 79*b* respectively, which flanges extend outwardly, could be omitted since they are not needed. The main supports 79 are spaced apart a distance, between the adjacent webs 85, slightly greater than the length of a firebrick 43. The supports 79 are fastened to the chamber wall 21, where they overlie it, by welding. In addition, the outer supports 79*a* and 79*b* are fastened to the wall 21 along the sides 51 and 53 of the opening 45 by welding. If necessary, the inner supports 79*c* and 79*d* can be supported at spaced locations along their length within opening 45 by pins 95 which pins 95 extend radially between the supports 79*c* and 79*d* and wall 33**.

A plurality of pairs 81 of straight secondary supports 83 extend between adjacent main supports 79. The secondary supports 83 in each pair 81 are spaced apart a distance slightly greater than the width of a firebrick 33. The secondary supports 83 rest on the flanges of the main supports 79 and are fastened in place by welding. Each pair 81 of supports 83 is spaced from the adjacent pair 81 by a distance sufficient to leave a narrow gap or slot 41 between the top surface 55 of adjacent firebricks 43 when the bricks are mounted on adjacent main supports 79 between adjacent pairs 81 of secondary supports 83.

The grid 57 supports the firebricks 43 in such a manner that an array of slots 41 are provided between the bricks to direct air from the distributing chamber to the burning chamber 23 in quantities sufficient to support combustion, and to fluidize the fuel passing over the firebricks. The grid 57 also supports the firebricks 43 in such a manner that they can be easily replaced.

If desired, use can be made of at least one firebrick 44 higher than the others in the group of firebricks 43 supported by the grid 57, as shown in FIG. 2. The higher firebrick 44 is mounted onto the grid so as to extend inwardly into the burning chamber 23. This arrangement advantageously permits to disturb at least partially the spiral movement of the material being burnt inside the burning chamber when this movement is too fast.

I claim:

1. A burner having:

a burning chamber defined by a substantially cylindrical wall provided with a heat resistant inner lining, the longitudinal axis of said chamber being generally horizontal, an outer wall encircling the wall to form an annular distributing chamber about the burning chamber, means for closing one end of the substantially cylindrical wall, means adjacent said one end for introducing a material to be burnt, tangentially into the chamber, means at said one end to ignite the material to have it burn as it moves spirally through the chamber away from the one end, means for supplying air under pressure through said distributing chamber into the burning chamber to support the combustion, a set of air inlets provided in the bottom portion of the burning chamber and connected to the air supplying means both to support combustion of the material to be burnt in the burning chamber and to fluidize the material being burnt with the pressurized air supplied, said air inlets comprising a plurality of narrow slots arranged in longitudinal columns and circumferential rows to provide a regular array extending over most of the length of the chamber in the bottom third thereof, said slots being formed by gaps left between a regular array of firebricks mounted in spaced apart relationship in an opening formed in both the walls of the chamber and the inner lining, said regular array of firebricks being arranged in longitudinal columns and circumferential rows, supported in the opening by a grid, so that the inner surfaces of said firebricks are generally flush with the inner surface of the chamber lining, one longitudinal column of firebrick supported by the grid being higher than the others and extending inwardly into the burning chamber to disturb at least partially the spiral movement of the material being burnt.

2. The burner as claimed in claim 1, including a circle of radially extending ports of large diameters joining the distributing chamber to the burning chamber adjacent the other end thereof to supply an additional amount of air and thus to ensure complete combustion of the material being burnt before it leaves the burner.

3. The burner as claimed in claims 1 or 2, including a plurality of circles of radially-extending ports of small diameter joining the distributing chamber to the burning chamber at given intervals along its length to supply a small amount of air into the burning chamber and thus to support combustion while simultaneously cooling the wall of said burning chamber.

* * * * *